US005669609A

United States Patent [19]

Reichert

[11] Patent Number: 5,669,609

[45] Date of Patent: Sep. 23, 1997

[54] TARGET FOR MISSILES, ESPECIALLY FOR THROWN MISSILES

[75] Inventor: Stefan Reichert, Waldalgesheim, Germany

[73] Assignee: NSM Aktiengesellschaft, Bingen am Rhein, Germany

[21] Appl. No.: 652,186

[22] Filed: May 23, 1996

Related U.S. Application Data

[63] Continuation of Ser. No. 360,404, Dec. 21, 1994, abandoned.

[30] Foreign Application Priority Data

Aug. 25, 1994 [DE] Germany ..... 44 29 894.3

[51] Int. Cl.[6] ..... F41J 3/00

[52] U.S. Cl. ..... 273/376; 273/371

[58] Field of Search ..... 273/371, 372, 273/373–376, 408, 409; D21/6

[56] References Cited

U.S. PATENT DOCUMENTS

| | | | |
|---|---|---|---|
| D. 54,877 | 4/1920 | Toohey | D21/6 |
| 4,561,660 | 12/1985 | Zammuto | 273/376 |
| 4,824,121 | 4/1989 | Beall et al. | 273/376 |
| 4,976,441 | 12/1990 | Kim | 273/376 |
| 5,116,063 | 5/1992 | Harlan et al. | 273/376 |
| 5,401,033 | 3/1995 | Lychock, Jr. | 273/372 X |

FOREIGN PATENT DOCUMENTS

| | | | |
|---|---|---|---|
| 495539 | 7/1992 | European Pat. Off. | 273/408 |
| 4002126A1 | 8/1991 | Germany . | |
| 4023359A1 | 1/1992 | Germany . | |
| 4200107A1 | 7/1993 | Germany . | |
| 4233980A1 | 4/1994 | Germany . | |
| 97895 | 2/1923 | Switzerland | 273/409 |
| 151792 | 10/1920 | United Kingdom | 273/408 |
| 1603505 | 11/1981 | United Kingdom | 273/408 |
| WO81/02255 | 8/1981 | WIPO | 273/376 |
| WO9412846 | 6/1994 | WIPO . | |

*Primary Examiner*—Paul E. Shapiro
*Attorney, Agent, or Firm*—Harness, Dickey & Pierce, P.L.C.

[57] ABSTRACT

A target, especially for thrown missiles such as darts, has a disk member divided into target fields. An evaluating unit to receive and process electronic signals or actuated contacts of the disk member is associated with the disk member. At least one target element is formed on the target fields. The target element, when subjected to loads by a missile, actuates a contact which is connected to the evaluating unit. Each target element is given a predetermined value by the evaluating unit. Further, at least two target elements may be combined to form one value unit.

8 Claims, 2 Drawing Sheets

TARGET FOR MISSILES, ESPECIALLY FOR THROWN MISSILES

This is a continuation of U.S. patent application Ser. No. 08/360,404 filed Dec. 21, 1994, now abandoned.

BACKGROUND OF THE INVENTION

The invention relates to a target for missiles, especially for thrown missiles, e.g. darts. The target is a disk member which is divided into target fields. The target fields include at least one target element which, when subjected to loads by a missile, actuates a contact which is connected to an evaluating unit to receive and process electronic signals of the actuated contacts. Each target element is given a predetermined value by the evaluating unit.

Targets of this type are described in EPO 319 840 B1. These targets include a plurality of individual independently insertable target elements which may be composed to form a disk member. The individual target elements are spaced by a holding means and are formed as groups. The holding means includes webs which extend between, and engage, the target elements.

The targets are used as dart targets which include a circular, planar disk member. The disk member has circular and radial webs which subdivide the disk member into annular fields which are partly subdivided into circular segments. The annular fields are composed of target elements. The target elements are given different values.

Also, targets of this type are used for electronic dart games. Such games include exchangeable target elements made of plastics. The target elements may be removed from the disk member. The target elements include apertures in their outer surfaces to receive darts. In the case of prior art games, it is common practice to use flexible darts. When a target element receives a dart, it is pressed in the direction of throwing against an inner pressure face of the disk member. In the process, the target element actuates a contact. The contact generates a pulse. The pulses are combined by a point evaluating means in the evaluating unit to form a total.

The evaluating unit is connected to the target elements of the target. The target, elements are received in a framed grid and movably held to a limited extent. The disk member includes an inner pressure face. Actuation of a target element causes actuation of a contact which, by means of an electronic pulse, initiates point evaluation in the evaluating unit. Because of their design and composition, which cannot be changed, games of this type are suitable for very few types of games, frequently only for one type of game.

SUMMARY OF THE INVENTION

It is an object of the invention to provide a target which is variable and which, in particular, is suitable for different uses. The objective is achieved by at least two target elements combined to form one value unit. One advantage of this embodiment, especially, concerns the variable target field sizes. It is possible to adapt the target field sizes to the requirements of the users. It is possible to reduce or increase, in size, the faces which are hit by the missiles by combining or separating the target elements. In this way, the target may be adapted to special requirements such as the distance between the person using the target and the disk member, the required degree of difficulty of the game and other throwing-technical requirements. In this way, the interest in using the target is increased and the economic aspects in using the targets are improved in commercial games. The target in accordance with the invention is not only suitable for dart games, but, also for archery and crossbow games. Furthermore, the target may also be used for practicing with rifles and hand weapons.

The target may be designed in such a way that, for the purpose of combining the target elements in a value unit, the contacts associated with the combined target elements are connectable to one another in the evaluating unit. In an alternative embodiment, the evaluating unit includes circuits to combine the target elements in the evaluating unit.

The target embodiment, which includes a variable target field size or the possibility of connecting or separating the target elements, is achieved, on the one hand, by connecting the target elements in a value unit or, on the other hand, by separating them again. The contacts of the combined target elements are connected in the evaluating unit such that they are given the same values. As far as this embodiment is concerned, it is proposed to provide the evaluating unit and/or the disk member with circuits. In an alternative embodiment of the invention, the target elements are combined by suitable electronic circuits in the evaluating unit. An assembly is also provided in which case the circuits are exchangeable. It is particularly advantageous if a plurality of possible completed switching specifications are provided which, above all, enable a number of variations in dividing up the target field of the disk member and associating different values therewith. As a result, the target is quickly adaptable in many ways to the requirements and abilities of the persons using the target. Such requirements may also be built in and selectable.

In another target embodiment, the target elements may be combined as groups to form target fields which are each associated with a value unit. The groups in this case are formed by value units which include adjoining target elements. It is possible to form groups which cover a certain surface region of the disk member. Furthermore, it is possible to form value unit groups which divide the disk member into areas of target elements of a predetermined value which are arranged either regularly or irregularly.

In a further embodiment, the groups of target elements all belong to the same or different target fields, with the term "target field" referring to a continuous area. Here, it is possible to divide the disk member into areas with the same value and of any size. Furthermore, by combining target elements of different target fields, it becomes possible to extend the areas of identical values in any direction of the total area of the disk member.

In a special embodiment, the target, in accordance with the invention, is used as a target of a dart game. The target includes a central circular field and annular arranged fields, with at least one annular field composed of target elements in the form of annular segments.

The surface of the disk member, if used in a game of darts, is divided up in a special way. The annular fields are characterised by different radial extensions. In a basic embodiment, five annular fields are provided of which the four outer annular fields are divided into annular segments. The complete disk member includes twenty uniformly radially distributed annular segments and five annular fields. The four outer annular fields are provided in the form of pairs of annular fields. The pairs have an outer radial narrower annular fields and an inner radial wider annular field. The respective annular segments of the outer annular fields, the first annular field and the circular field include different value units which each depend on the position of the respective annular field relative to the center. They are combinable to form the total result in the evaluating unit.

In a further embodiment of the target, when used in a game of darts, at least six annular fields are provided of which at least five annular fields are divided into annular segments. Here, radially arranged pairs of annular fields with a narrower outer annular field and a wider inner annular field form the disk member. The six outer annular fields are each subdivided into twenty uniformly radially distributed segments.

The disk member preferably includes the same total area as the basic design with five annular fields. Here, the sixth annular field is obtained by dividing one of the four outer annular fields of a target including five annular fields and one central circular field. This embodiment includes at least one further annular field which serves to increase the degree of difficulty by reducing the size of the target element areas. Thus, the total area of the disk member is divided into smaller areas to form groups of predetermined values. The reduction in the size of the areas by subdividing existing annular fields used as target fields including combined target elements is achieved by separating the combined target elements from their predetermined association with a value unit of the annular field and by re-combining the target elements in at least two annular fields which are each associated with a group with a value unit.

The target, when used in a game of darts, in another embodiment, is designed such that the circuits are selectable and/or replaceable, depending on the game specifications. The game specification is determined, especially by the disk member, by the way in which it is subdivided. By selecting, altering or combining the circuits, it becomes possible to set different degrees of difficulty, to adjust the values to the players. Thus, it is possible to take the abilities of the players into account. Furthermore, by providing special target embodiments, it is possible to use the target for different game specifications and types of game. In particular, it is possible to use the game commercially. In the different embodiments it is possible, for example, to connect the evaluating units to external coin counting or credit debiting means and/or to circuits to provide the possibility of selecting different game specifications.

In a further embodiment of the target, the evaluating unit and/or the disk member is connected to switching means which enables the game specifications to be selectable. The means as proposed are mechanically actuatable switches as well as other prior art switching devices. The embodiment is such that the value for each target element is individually selectable or that the values for all target elements are jointly selectable. In this embodiment, the target may be divided and the values allocated as required by the target user. Furthermore, the values may be selected in such a way that all target elements are predetermined jointly. It is possible for the target user to select the entire game specification for the target.

Furthermore, the evaluating unit may be connected to an indicating unit to illustrate the point results visually.

From the following detailed description taken in conjunction with the accompanying drawings and subjoined claims, other objects and advantages of the present invention will become apparent to those skilled in the art.

BRIEF DESCRIPTION OF THE DRAWINGS

Two target embodiments are illustrated in the drawings wherein.

DETAILED DESCRIPTION OF THE PREFERRED EMBODIMENTS

Figure 1:
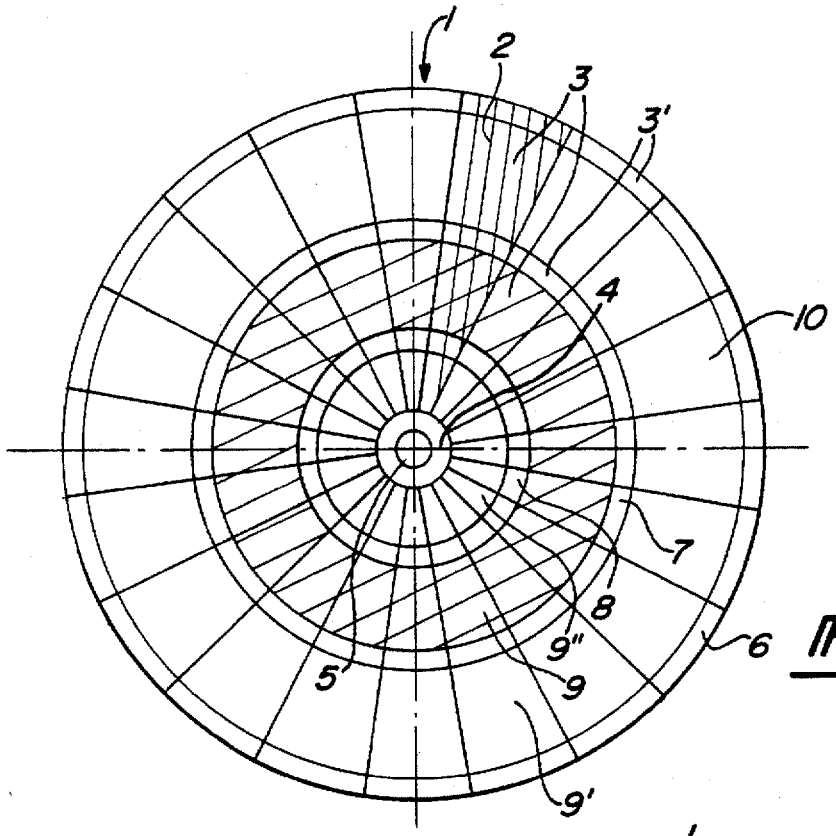
FIG. 1 is a plan view of a dart game with seven annular fields and a central circular field.

The target 10 shown in FIG. 1 is a dart game target. The target 10 includes a disk member 1 with seven annular fields 3, 3', 4 and a central circular field 5, all which constitute target fields. The outer six annular fields 3, 3' are subdivided into three pairs each including a narrow annular field 3' and a wide annular field 3. The annular fields 3, 3', 4 are arranged radially around the central circular field 5. The first annular field 4 is a target field which includes one single target element and forms a value unit.

The six outer annular fields 3, 3' are each subdivided into twenty circular segments 2 which constitute target elements. Each annular segment 2 is associated with a value unit. This value unit is predetermined by the evaluating unit 11 illustrated in FIG. 3. The individual annular segments 2 are evaluated in accordance with the rules of a conventional dart game.

The annular fields 3, 3', 4 are associated with value units 6, 7, 8, 9, 9', 9". When calculated, they affect the total as follows. The central circular field 5 is given a double value. The value of the adjoining first annular field 4 is selectable by the player. All wide radial annular fields 3 are given value units 9, 9', 9" which are single values. The narrow radial annular fields 3' are given value units 6, 7, 8. These are quadruple, triple and double values. The outer four annular fields of the target 10 are subdivided as is common practice for a conventional dart game, as illustrated in FIG. 2.

Furthermore, the target 10 includes a further pair of annular fields 3, 3', each including a narrow radial annular field 3' and a wide radial annular field 3. The additional wide radial annular field 3' is given the value unit 9", which constitutes a single value. The narrow radial annular field 3' is given the value unit 8 which constitutes a quadruple value. The further pair of annular fields 3, 3' is produced by subdividing an annular field 3 already including combined target elements. In this case, the combined target elements are disconnected and combined to form new target fields with new value units 8, 9" in accordance with the new division. The remaining part of the target elements of the original annular field 3 continues to be associated with the original value unit 9.

Figure 2:
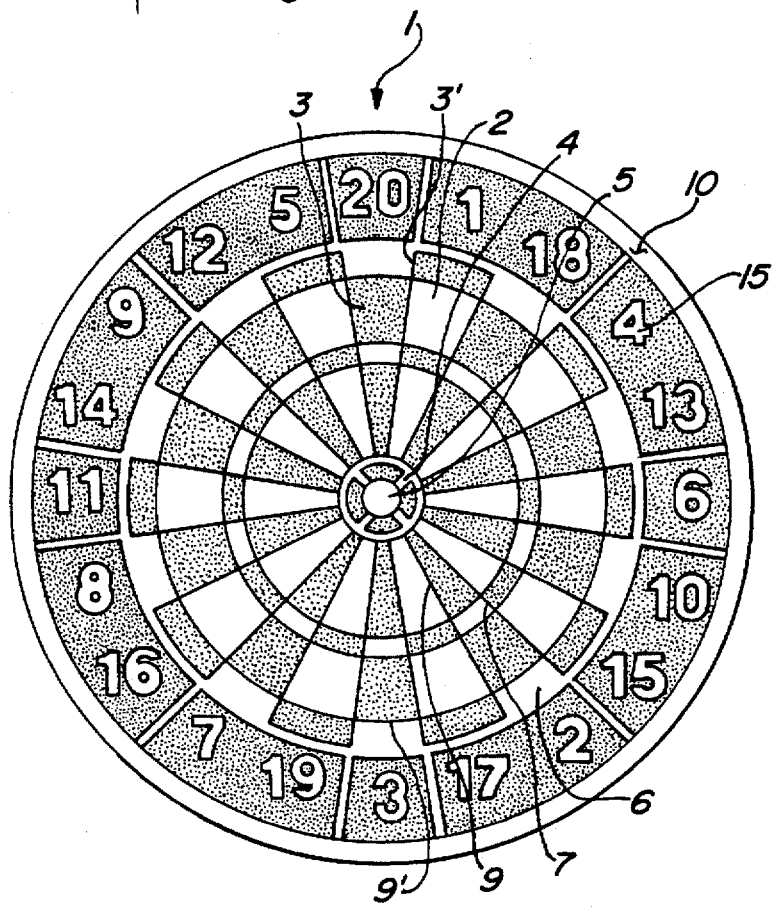
FIG. 2 is a plan view of a dart game with five annular fields and a central circular field.
Figure 3:
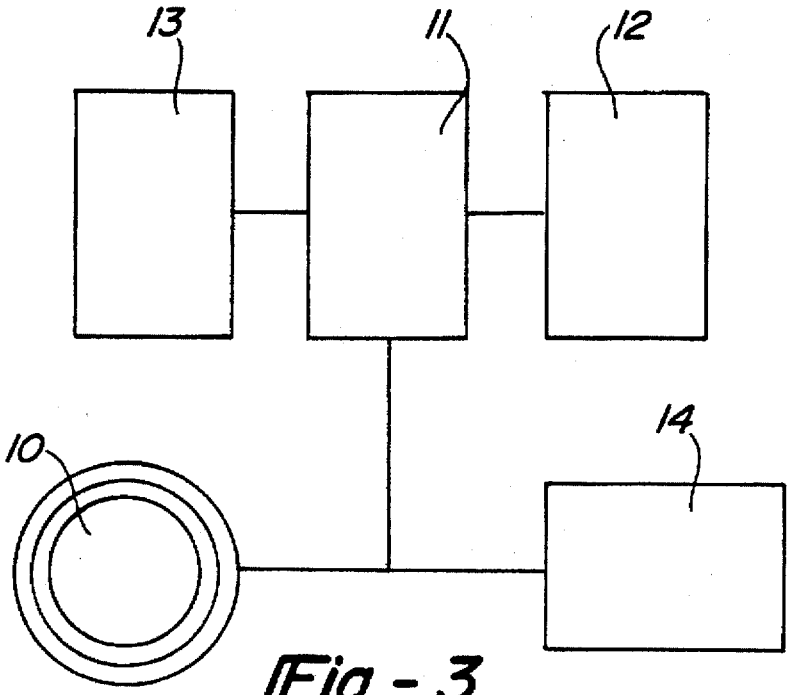
FIG. 3 is a schematic view of a block circuit diagram of a target assembly.

The newly formed annular fields 3, 3', which are connected accordingly in the evaluating unit 11 as illustrated in FIG. 3, are associated with the above-described value unit. For this purpose, the target elements of an annular field 3, 3' are combined to form the respective value unit. The newly produced annular fields, in turn, include annular segments 2 so that the value of each annular segment 2, in accordance with the value unit of the respective target element as hit, is converted into a throwing result and combined to form a total. By varying the way in which the target is divided, it is possible to obtain a dart game target in accordance with the conventional rules of the game, as illustrated in FIG. 2. In addition, it is possible to allow new game variants by modifying the target.

FIG. 2 shows a target 10 of a conventional dart game. The target 10 is mounted on a disk member 1 with an external ring 15 and a central circular field 5. A first annular field 4 is positioned around the central circular field 5. Four further annular fields 3, 3', with value units 6, 7, 9, 9', which form two pairs are positioned around the first annular field 4. The pairs are each divided into an inner wider radial annular field 3 and an outer narrower radial annular field 3'. As is common practice with conventional dart game targets, the values of the annular segments 2 are written into the outer ring 15. The figures indicate the values of the annular segments 2. For conventional dart game targets, the values of the annular fields 3, 3', 4 are obtained as follows. The wide radial annular fields 3 have single values. The narrow radial annular fields 3', from the outside to the inside, enter the calculated total with double or triple values and constitute the value unit 6, 7.

FIG. 3 shows a block circuit diagram with a target 10 and the electronic units. The central element of the assembly is the evaluating unit 11. The target 10, by means of the evaluating unit 11, is connected to the switching means 12, which selects game specifications and also to the coin machine 13. To indicate the stage which the game has reached, an indicating unit 14 is connected to the evaluating unit 11 and/or to the target 10 itself.

The dart game functions after coins have been deposited into the coin machine 13. The deposit of coins places the evaluating unit 11 into a state of readiness. As a result, it becomes possible to select the game specifications via the switching means 12. After the game specifications have been selected by the switching means 12, the evaluating unit 11 indicates the value of the target elements and the subdivision of the target fields on the target. The indicating unit 14 indicates the game results as calculated by the evaluating unit 11. Furthermore, the indicating unit 14 is capable of indicating the value of the target element that has been hit.

Figure 4A:
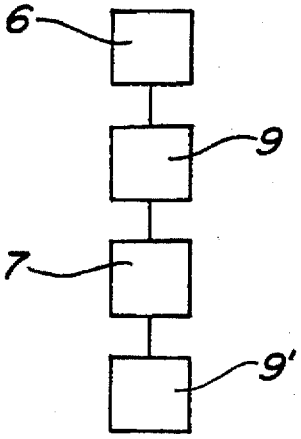
FIG. 4*a* and 4*b* are schematic views of functional diagrams of dart game targets.
Figure 4B:
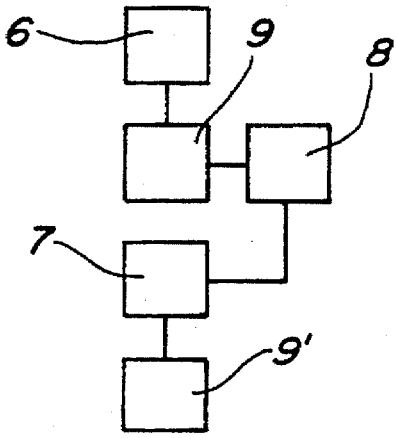

FIGS. 4*a* and 4*b* are functional diagrams of a dart game target with annular fields which have been allocated different value units 6, 7, 8, 9, 9'. FIG. 4*a* shows that the target has been subdivided into four annular fields 3, 3' of value units 6, 7, 9, 9'. FIG. 4*b* shows a target 10 divided into five annular fields 3, 3' of different value units 6, 7, 8, 9, 9'. To obtain a further annular field 3 on the target 10, a wide annular field 3 with the value unit 9 is divided into two independent annular fields 3, 3', with different value units 8, 9 being allocated to the annular fields 3, 3'.

FIG. 2 corresponds to the conventional dart game target. The embodiment includes four annular fields 3, 3' which are subdivided into annular segments 2.

While the above detailed description describes the preferred embodiment of the present invention, the invention is susceptible to modification, variation, and alteration without deviating from the scope and fair meaning of the subjoined claims.

I claim:

1. A target for missiles, especially for thrown missiles, such as darts, comprising:

a disk member divided into target fields;

a plurality of target elements located in said target fields;

means associated with each target element for causing an electronic signal to be generated when that target element is subjected to a load by a missile;

an evaluating unit for receiving and processing the electronic signals caused to be generated by the target elements and assigning one of a number of different values to each signal whereby each target is associated with an assigned value; and at least one target element which, when subjected to loads by a missile, actuates a contact which is connected to said evaluating unit;

each target element being given a predetermined value by the evaluating unit and said value being able to be means for changing which target elements and the number of target elements which are associated with each assigned value; whereby the area of the target assigned each value may be changed and the target may target may be varied to form different value patterns.

2. A target according to claim 1, wherein the means associated with each target element for causing an electronic signal to be generated includes contacts associated with each target element, and the means for changing includes means in the evaluating unit for connecting together the contacts associated with different target elements.

3. A target according to claim 1, wherein the means for changing includes circuits in the evaluating unit.

4. A target according to claim 1, wherein the means for changing includes means for associating at least two adjacent target elements as a group with a common value.

5. A target according to claim 1, wherein when said target elements are arranged to include a central circular target element field and annular fields arranged therearound, at least one outer annular field being composed of target elements in the form of annular segments.

6. A target according to claim 5, wherein the central circular field is surrounded by five annular fields and four outer annular fields include annular segments.

7. A target according to claim 6, wherein the central circular field is surrounded by at least six annular fields and five outer annular fields are composed of annular segments.

8. A target according to claim 7, wherein the sixth annular field comprises one of the four outer annular fields of a target composed of a central circular field and five annular fields being subdivided into two annular fields.

* * * * *

UNITED STATES PATENT AND TRADEMARK OFFICE

CERTIFICATE OF CORRECTION

PATENT NO. : 5,669,609

DATED : September 23, 1997

INVENTOR(S) : Stefan Reichert

It is certified that error appears in the above-identified patent and that said Letters Patent is hereby corrected as shown below:

Column 6, line 18, Claim 1, after "be", insert --varied; and--

Column 6, line 23, Claim 1, delete "target may"

Signed and Sealed this

Seventh Day of April, 1998

Bruce Lehman

*Attest:*

BRUCE LEHMAN

*Attesting Officer*

*Commissioner of Patents and Trademarks*